United States Patent [19]

Horvay et al.

[11] 4,306,757

[45] Dec. 22, 1981

[54] REFRIGERATOR INCLUDING THROUGH-THE-DOOR ICE SERVICE

[75] Inventors: Julius B. Horvay; William M. Webb, both of Louisville, Ky.

[73] Assignee: General Electric Company, Louisville, Ky.

[21] Appl. No.: 153,300

[22] Filed: May 27, 1980

[51] Int. Cl.[3] ..... F25C 5/18; A47B 81/00

[52] U.S. Cl. ..... 312/292; 312/127; 312/248; 312/276; 62/377

[58] Field of Search ..... 221/205; 222/361; 312/292, 248, 211, 271, 276, 127; 62/344, 377

[56] References Cited

U.S. PATENT DOCUMENTS

| | | | |
|---|---|---|---|
| 742,459 | 10/1903 | Lewis et al. | 312/127 |
| 872,662 | 12/1907 | Malone | 312/276 |
| 1,443,858 | 1/1923 | Windecker | 312/276 |
| 1,773,329 | 8/1930 | Upham | 221/205 |
| 2,075,988 | 4/1937 | Johnson | 221/205 |
| 2,187,218 | 1/1940 | Witt | 221/205 |
| 2,212,405 | 8/1940 | Rose et al. | 62/344 |
| 2,310,933 | 2/1943 | Burger | 221/205 |
| 2,348,442 | 5/1944 | Banck | 221/205 |
| 2,355,793 | 8/1944 | Fyock | 312/276 |
| 2,697,918 | 12/1954 | Comstock | 62/344 |
| 2,953,419 | 9/1960 | Ingolia | 312/276 |
| 2,966,386 | 12/1960 | Gross | 312/276 |
| 3,572,053 | 3/1971 | Jacobus | 62/344 |
| 3,602,007 | 8/1971 | Drieci | 62/344 |
| 3,640,088 | 2/1972 | Jacobus et al. | 62/344 |
| 3,747,363 | 7/1973 | Grimm | 62/377 |
| 3,762,790 | 10/1973 | Neuwirth | 312/248 |
| 3,883,204 | 5/1975 | Prada et al. | 62/344 |
| 3,887,119 | 6/1975 | Sucro et al. | 62/344 |
| 4,087,140 | 5/1978 | Linstromberg | 312/292 |
| 4,227,383 | 10/1980 | Horvay | 62/344 |

*Primary Examiner*—Victor N. Sakran
*Attorney, Agent, or Firm*—Frederick P. Weidner; Radford M. Reams

[57] ABSTRACT

A refrigerator, including a freezer compartment and a door for closing the access opening to said compartment. There is an opening through the door and an ice piece receptacle on the inner surface of the freezer door. A closure member is pivotally mounted at the bottom thereof to the door and movable outwardly therefrom and the closure member has side panels secured to the inner surface and extending rearwardly of the closure member. The ice storage receptacle supported on the inner surface of the door has the interior thereof accessible through the opening in the door and the receptacle has a floor movable from a first position when the closure member is closed to a second elevated position when the closure member is opened to permit manual removal of ice pieces from the ice receptacle without opening the door.

8 Claims, 3 Drawing Figures

REFRIGERATOR INCLUDING THROUGH-THE-DOOR ICE SERVICE

BACKGROUND OF THE INVENTION

The present invention is directed to a household refrigerator including a freezer compartment containing an ice receptacle mounted on the interior surface of the freezer access door and manually-operable means for access to the ice pieces in the receptacle without opening the entire freezer door.

U.S. Pat. No. 3,572,053—Jacobus et al and U.S. Pat. No. 3,640,088—Jacobus et al disclose household refrigerators including exterior ice service having an ice passage in a freezer door and combination receptacle and dispensing means for delivering batches of ice pieces from the receptacle to the passage. The dispensing means is motor operated and designed to deliver batches of ice pieces periodically to the passage during operation of the motor.

U.S. Pat. Nos. 2,212,405—Rose et al and 2,697,918—Comstock disclose exterior ice services in which ice pieces are dispatched directly from an ice maker through a cabinet wall or the cabinet door, the amount of ice available at any one time being limited by the storage capacity of the ice makers.

U.S. Pat. No. 3,602,007—Drieci discloses through-the-door ice service comprising a receptacle mounted on the interior surface of a small ice access door provided in the main freezer door so that the ice stored in the receptacle is available exteriorly by opening the pivoted ice access door without opening the main freezer door.

U.S. Pat. No. 3,747,363—Grimm discloses a refrigerator including an ice piece storage receptacle on the inner surface of the freezer door, a passage through the door communicating with the interior of the receptacle and a closure member pivotally mounted on the exterior surface of the freezer door for closing the passage. The closure member carries a delivery tube extending through the passage and up into the storage receptacle for picking up ice pieces from the receptacle and delivering the ice pieces to the exterior of the freezer door when the closure member is opened. There is also disclosed stop means for limiting the passage of ice pieces through the delivery tube when the closure member is opened.

The present invention is directed to an improved exterior ice service combining the advantages of an ice storage receptacle for storing a relatively large amount of ice pieces with a manually-operable means for access to the ice pieces exteriorly of the refrigerator, without opening the main freezer door.

SUMMARY OF THE INVENTION

There is provided a refrigerator comprising a freezer compartment and a main freezer door for closing the access opening to the compartment and an ice storage receptacle supported on the inner surface of the freezer door. The freezer door has an opening therethrough with a closure member for opening and closing the opening pivotally mounted at the bottom thereof to the door and movable outwardly therefrom. The closure member has side panels secured to the inner surface of the closure member and extending rearwardly thereof. The interior of the ice storage receptacle is accessible through the opening in the door when the closure member is opened. The receptacle has a floor movable from a first position as when the closure member is closed, to a second elevated position as when the closure member is opened, to permit manual removal of the ice pieces from the ice receptacle without opening the freezer door.

BRIEF DESCRIPTION OF THE DRAWINGS

With reference to the accompanying drawings.

DESCRIPTION OF THE PREFERRED EMBODIMENT

Figure 1:
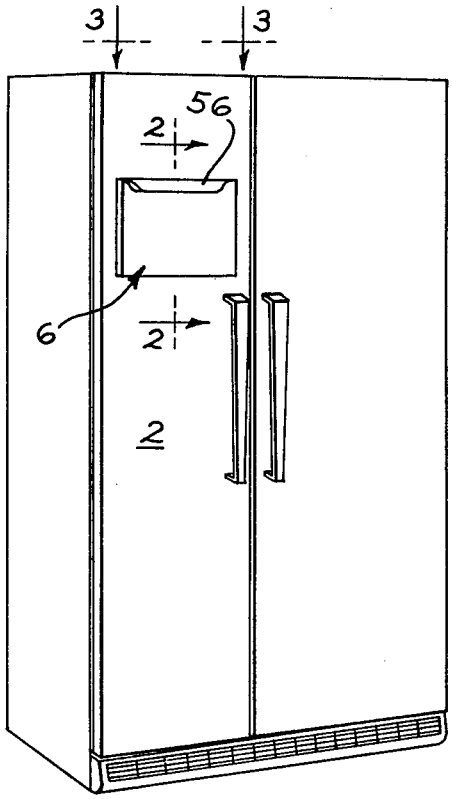
FIG. 1 is a prespective view of a refrigerator including the ice access assembly of the present invention in its non-access position.

With reference to the accompanying drawings, there is shown a household refrigerator including a freezer compartment 1 having an access opening at the front thereof closed by a main freezer door 2. The door 2 has an outer wall 9 and an inner wall 11 with insulation 13 therebetween. While the drawings illustrate a side-by-side type of refrigerator where the freezer compartment is on one side and the fresh food compartment is on the other side, this invention may also be utilized with a refrigerator of the type having the freezer compartment above or below the fresh food compartment. An ice piece storage receptacle 3 is suitably supported on the inner surface 4 of the inner wall 11 of the freezer door 2, the receptacle 3 being adapted to store a substantial quantity of ice pieces. The receptacle 3 may be manually filled with ice pieces although preferably ice pieces are supplied to the storage receptacle 3 and the receptacle kept filled with ice pieces by a suitable ice maker (not shown) such as described in the aforementioned Drieci U.S. Pat. No. 3,602,007 or Swerbinsky U.S. Pat. No. 3,621,668, both of which patents are assigned to the same assignee as the present invention.

The freezer door 2 has an ice access opening 5 formed therethrough and a closure member 6 for opening and closing the access opening 5 is pivotally connected at the lower edge thereof by hinge means 8 to the freezer door 2. The closure member 6 is pivotally movable relative to the freezer door 2 between a first closed position as shown in full line in FIG. 2 and a second open position as shown in phantom in FIG. 2. When the closure member 6 is at least partially open there is access to the ice piece receptacle 3 without opening the main freezer door 2.

Figure 2:
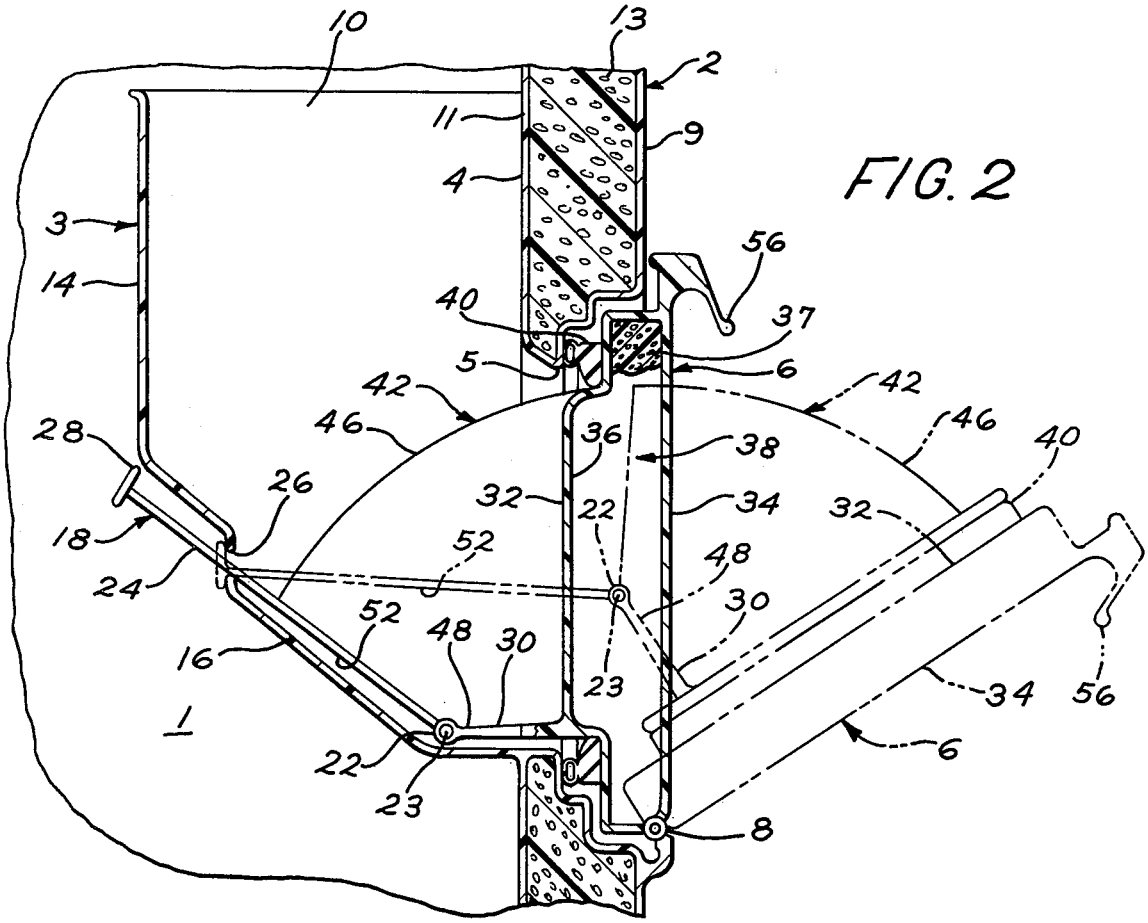
FIG. 2 is a cross sectional view taken along lines 2—2 of FIG. 1 showing the ice access assembly in its non-access position in full line and its access position in phantom line.
Figure 3:
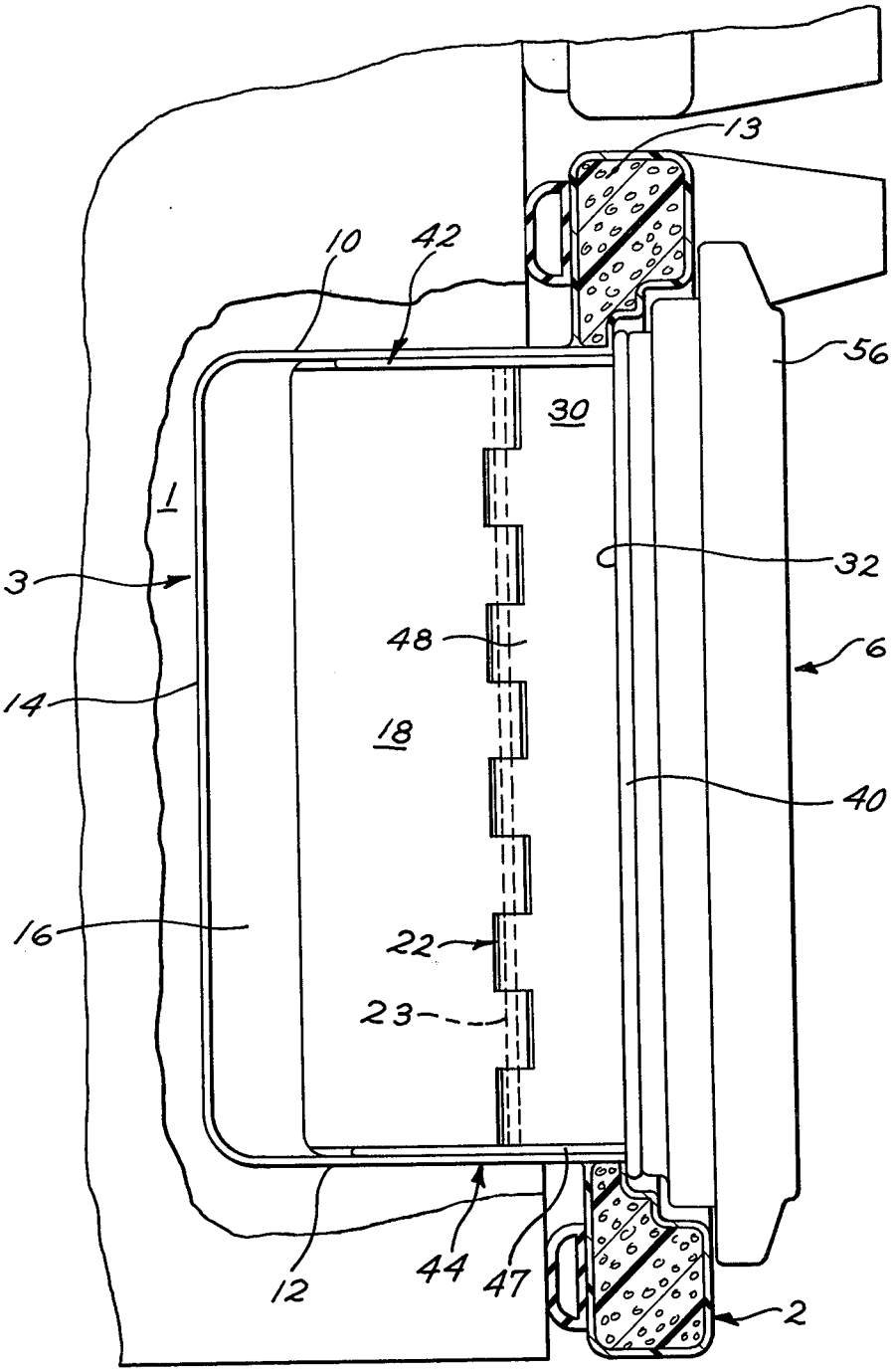
FIG. 3 is a top-plan view taken along lines 3—3 of FIG. 1 with portions broken away.

The ice piece dispensing or access assembly includes the ice storage receptacle 3 which is secured to the inner surface 4 of the freezer door 2 and has side walls 10 and 12, rear wall 14 and a bottom wall 16 sloping downwardly toward the door 2. There is provided a floor 18 which is movable relative to the bottom wall 16 of the receptacle 3. The forward end portion 20 of the floor 18 is hingedly secured or attached to closure member 6 as by a hinge 22 having a hinge pin 23 which extends across receptacle 3 between side walls 10 and 12. The rearward end portion 24 of the floor 18 moves or slides through a slot opening 26 in the bottom wall 16 of the receptacle 3 as the floor 18 is moved relative to the bottom wall 16, the slot opening being slightly larger than the thickness of the floor 18. The terminal end 28 of the rearward end portion 24 has a stop means which is larger in dimension than the slot opening 26 so that when the stop means abuts the portion of the bottom wall 16 surrounding the slot opening 26, it will prevent further forward movement of the floor 18. FIG. 2 shows in phantom the stop means in this latter position. The hinge 22 interconnects the floor 18 and the closure member 6, in the case of the preferred embodiment, by a flange 30 that depends perpendicularly from and extends rearwardly of the inner surface 32 of the closure member 6. The closure member 6 is a sandwich type wherein there is an outer wall 34 and an inner wall 36 and usually there is insulation 37 in the space 38 therebetween. The closure member 6 seals the opening 5 when it is in its closed position by means of a gasket 40 which may be secured to the door 2 or preferably to the inner surface 32 of the closure member 6 and surrounds the opening 5 when the closure member 6 is closed as is shown in full line in FIG. 2. The closure member 6 also has side panels 42 and 44 which are secured to the inner surface 32 of the inner wall 36 and extend rearwardly of the closure member 6. In the preferred embodiment illustrated in the drawings, the side panels 42 and 44 each have an arcuate or curved upper edge 46 and 47 respectively to allow clearance at the top of opening 5 when the closure member 6 is opened and closed as by pivoting about hinge means 8. The bottom edge of the side panels 42 and 44 each have a portion 48 abutting flange 30 and a portion 52 at an angle relative to the respective portions 48 which will accommodate the shape of floor 18 when closure member 6 is in its closed position as shown in full line in FIG. 2.

The ice piece access assembly described above operates as follows: The ice piece receptacle 3 is filled with ice pieces either manually or by an automatic ice maker that periodically harvests ice pieces into the receptacle. The closure member 6 is in its closed positon when not being used thus sealing off any escape of cold air from within the freezer compartment 1 by the sealing gasket 40 surrounding the opening 5 and also the insulation 37 between the outer wall 34 and inner wall 36. In this closed position, the ice pieces fill at least the bottom of the receptacle and rest up against the inner surface 32, the flange 30, side panels 42 and 44 and the floor 18. In the closed position, the floor 18 is inclined downwardly toward the door 6 and the terminal end 28 stop element is spaced from the slot opening 26 in the bottom wall 16. As the door 6 is pulled forward and downwardly as by means of grip 56 to pivot it about hinge means 8, flange 30 is rotated also about closure member hinge means 8 causing floor member 18, hinged to flange 30, to be moved from its first position shown in full line in FIG. 2 to a second elevated position as shown in phantom line in FIG. 2. The terminal end 28 stop element abuts the bottom wall 16 surrounding the slot 26 and prevents the closure member 6 and floor 18 from further forward movement. As the floor 18 is moved from its lower first position to its second elevated position in unison with opening of the closure member 6, the ice pieces within the receptacle 3 are moved by the floor 18 forward toward the opening 5. The ice pieces are prevented from falling out on either side of the closure member 6 by the side panels 42 and 44. When the closure member 6 is in its open position as shown in phantom line in FIG. 2, access is permitted through the opening 5 to the ice pieces so that a person can manually remove the ice pieces from within the receptacle 3. When the desired amount of ice pieces have been removed from the receptacle 3, the closure member 6 is closed causing flange 30 to again be pivoted about hinge means 8 and in turn moves the floor 18 from its second elevated position downwardly and rearwardly to its first position in close proximity to the bottom wall 16 of the receptacle 3. Thus, the removal of ice pieces from within the receptacle 3 is accomplished without the need to open the freeze door 2 which, of course, is a desirable energy saving feature.

While there has been shown and described a specific embodiment of the invention, it will be understood that it is not limited thereto and that it is intended by the appended claims to cover all such modifications that fall within the true spirit and scope of the invention.

What is claimed is:

1. In a refrigerator comprising a freezer compartment and a door for closing the access opening to said compartment, an ice piece access assembly comprising:

an opening through the door;

a closure member being pivotedly mounted at the bottom thereof to the door and movable outwardly therefrom, said closure member having side panels secured to the inner surface and extending rearwardly of the closure member; and an ice storage receptacle supported on the inner surface of the door with the interior thereof accessible through the opening in the door, said receptacle having a rigid floor movable from a first position when the closure member is closed to a second elevated position when the closure member is opened to permit manual removal of ice pieces from the ice receptacle without opening the door and movable to the first position when the closure member is closed.

2. The refrigerator of claim 1 wherein the floor member is hingedly secured to the closure member for movement therewith.

3. The refrigerator of claim 1 wherein the floor member is movable forwardly upon being moved to the second elevated position.

4. The refrigerator of claim 3 wherein the floor member has a stop member to limit forward movement of the floor member to a predetermined distance.

5. The refrigerator of claim 1 wherein the closure member is a sandwich construction with insulation between the inner and outer surfaces and a gasket surrounds the opening in the door.

6. The refrigerator of claim 5 wherein the gasket is secured to the inner surface of the closure member and surrounds the opening in the door when the closure member is closed.

7. The refrigerator of claim 1 wherein the ice storage receptacle has a bottom wall sloping downwardly toward the door and the floor is parallel thereto when in its first position.

8. The refrigerator of claim 7 wherein the bottom wall has a slot opening through which the floor passes during movement thereof.

* * * * *